United States Patent [19]

D'Alto

[11] Patent Number: 4,996,805

[45] Date of Patent: Mar. 5, 1991

[54] TRACK MOUNTED MOVEABLE MAUSOLEUM COVERS

[76] Inventor: Joseph D'Alto, 89 Hurbert St., Brooklyn, N.Y. 11222

[21] Appl. No.: 525,324

[22] Filed: May 17, 1990

[51] Int. Cl.[5] ..... E04H 13/00

[52] U.S. Cl. ..... 52/137; 52/134; 49/66

[58] Field of Search ..... 52/134, 136, 137, 142, 52/236.3; 49/66, 65

[56] References Cited

U.S. PATENT DOCUMENTS

| | | | |
|---|---|---|---|
| 2,220,400 | 11/1940 | Faris | 49/372 |
| 2,842,808 | 7/1958 | Kuhnke | 49/372 |
| 3,058,174 | 10/1962 | Sterling | 49/372 |
| 3,480,989 | 12/1969 | Edeus | 49/372 |
| 3,778,942 | 12/1973 | Bondi | 52/134 |
| 3,888,055 | 6/1975 | Gallo | 52/136 X |
| 4,325,204 | 4/1982 | Martine | 49/372 |
| 4,523,413 | 6/1985 | Koppenberg | 52/134 X |
| 4,614,066 | 9/1986 | Koppenberg | 52/134 |
| 4,633,614 | 1/1987 | Van Weelden | 49/409 |
| 4,648,219 | 3/1987 | Johston, Sr. | 52/136 X |

*Primary Examiner*—David A. Scherbel
*Assistant Examiner*—Creighton Smith
*Attorney, Agent, or Firm*—Collard, Roe & Galgano

[57] ABSTRACT

A moveable mausoleum cover comprises at least one row of at least one crypt cover door moveable horizontally; the door has a front surface and a rear surface. A pocket wall comprises an end panel adjacent to the door and rotatable around a pivot point, between a closed position and an open position; the end panel having a front surface and a rear surface. A horizontal track is located a spaced distance behind the rear surface of the crypt cover door and a spaced distance behind the rear surface of the end panel; the track having a hollow guide rail. A connector means is contained within the hollow guide rail; and there is a means for mounting the connector means to the rear surface of the crypt cover door. The end panel in its closed position prevents horizontal movement of the moveable crypt cover door, and the end panel in its open position permitting horizontal movement of the moveable crypt cover door along the horizontal track to a location behind the rear surface of the end panel, in order to expose a crypt located behind the door.

10 Claims, 2 Drawing Sheets

TRACK MOUNTED MOVEABLE MAUSOLEUM COVERS

BACKGROUND OF THE INVENTION

1. Field of the Invention

The present invention relates to providing an easily moveable mausoleum or crypt cover, for the purpose of moving a casket already contained in the crypt, or of placing a new casket therein.

2. The Prior Art

U.S. Pat. No. 2,220,400, to Faris, shows a sliding pocket door mounted in an overhead hollow T-shaped rail or track, by means of a pair of parallel rollers essentially forming a T-shaped connection.

U.S. Pat. No. 2,842,808, to Kuhnke, shows a pocket door assembly, wherein the door is slidably mounted in an overhead hollow T-shaped rail by means of parallel mounted rollers in the form of a T arranged at the top of the door.

U.S. Pat. No. 3,058,174, to Sterling, shows a pocket door frame assembly, wherein the door is slidably mounted on an overhead guide rail by means of rollers, so as to slide the door into a wall enclosed on both sides thereof.

U.S. Pat. No. 3,480,989, to Edeus, again shows a pocket door assembly, wherein a door is slidably mounted on an overhead track by means of rollers, so as to slide into a wall enclosing both sides of the door.

U.S. Pat. No. 4,325,204, to Martine, shows a pocket door assembly, wherein the door is slidably mounted on an overhead track by means of rollers, so as to slide into a wall enclosing both sides of the door.

U.S. Pat. No. 4,633,614, to Van Weelden, shows a shower tub enclosure, having a sliding door which is mounted on an overhead track which is substantially an internal T-shape, wherein the door has a T-shaped connection formed by a pair of parallel rollers which engage in the T-shaped rail.

SUMMARY OF THE INVENTION

It is an object of the present invention to provide an easily moveable mausoleum or crypt cover, so as to overcome the problem associated with physically removing such covers, which are heavy and unwieldy, for the purpose of moving a casket already contained in the crypt, or of placing a new casket therein.

It is another object of the present invention to provide track mounted covers for each individual crypt in a mausoleum, having banks of vertical crypts arranged side by side, wherein an end bank in the mausoleum forms a pocket wall into which a set of horizontal guide tracks extend. These horizontal tracks enable adjacent banks of crypt covers in the mausoleum to be guided into the pocket wall so as to expose and open the crypts in the vertical bank adjacent to the pocket wall. In order to gain access to crypts in vertical banks further removed from the pocket wall, it is only necessary to slide the crypt cover on its track in the bank adjacent to the pocket wall into the pocket wall, and then each succeeding cover in the same horizontal line can be displaced by one crypt until the desired crypt is opened. The horizontal tracks consist of a T-shaped hollow guide rail mounted at the top and bottom of the horizontally arranged crypt covers, into which are fitted plastic coated low friction T-connections which are mounted to the crypt covers. The pocket wall itself can form a storage compartment since it has the depth of a crypt and can be covered by means of a hinged panel.

The above objects are accomplished in accordance with the present invention by providing a moveable mausoleum cover comprising at least one row of at least one crypt cover door moveable horizontally; said door having a front surface and a rear surface; a pocket wall comprising an end panel adjacent to said door and rotatable around a pivot point between a closed position and an open position; said end panel having a front surface and a rear surface; a horizontal track located a spaced distance behind the rear surface of said crypt cover door and a spaced distance behind the rear surface of said end panel; said track having a hollow guide rail; a connector means contained within said hollow guide rail; means for mounting said connector means to the rear surface of said crypt cover door; and said end panel in said closed position preventing horizontal movement of said moveable crypt cover door, and said end panel in said open position permitting horizontal movement of said moveable crypt cover door along said horizontal track to a location behind the rear surface of said end panel.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing wherein similar reference characters denote similar elements throughout the several views.

DETAILED DESCRIPTION OF THE PREFERRED EMBODIMENT

Figure 1:
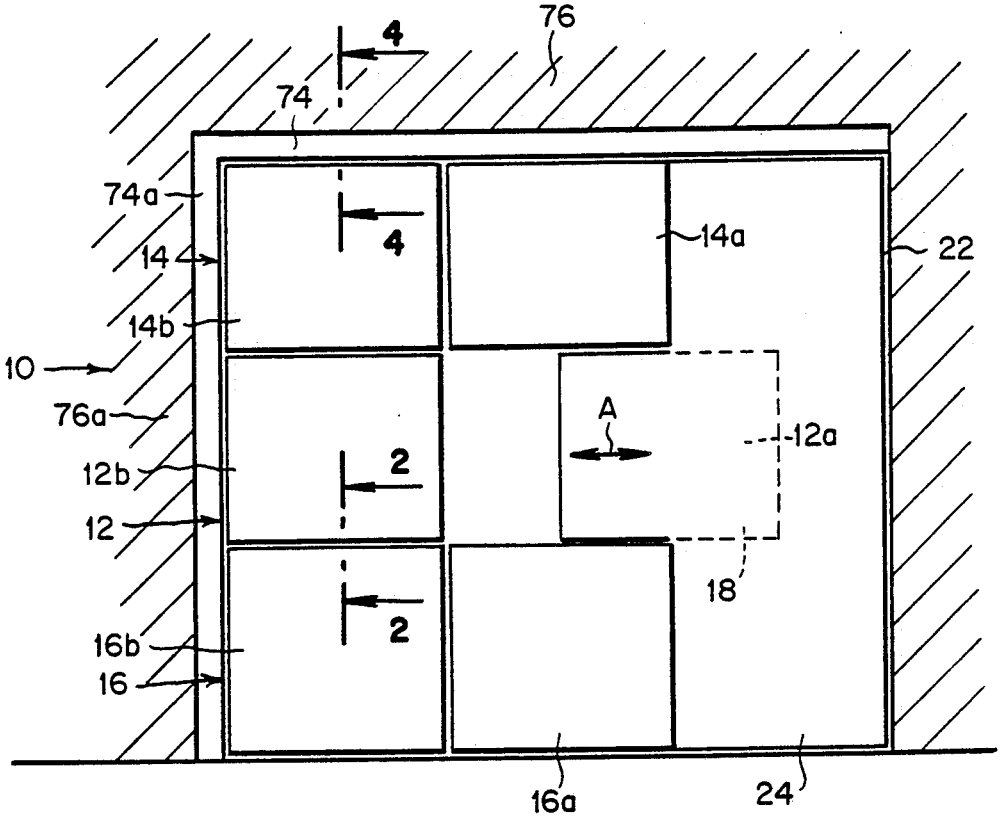
FIG. 1 shows a front view of the mausoleum cover of the invention.

Turning now in detail to the drawings, FIG. 1 shows a moveable mausoleum cover 10 comprising at least one row 12 of at least one crypt cover door 12*a* moveable horizontally, to the left and to the right as indicated by arrow A. As shown in FIG. 1 the row 12 includes at least two crypt cover doors 12*a* and 12*b* both of which are moveable horizontally. Each door is moveable independently from every other door. As can be seen in FIG. 1, there are at least two horizontal rows, and specifically there are shown three horizontal rows of moveable crypt cover doors. The middle row is designated as row 12, while the upper row above row 12 is row 14; and the lower row below row 12 is row 16. The horizontally moveable doors in the upper row 14 are doors 14*a* and 14*b*. The horizontally moveable doors in the lower row are doors 16*a* and 16*b*. Each door in each row is horizontally moveable independently from every other door.

Figure 3:
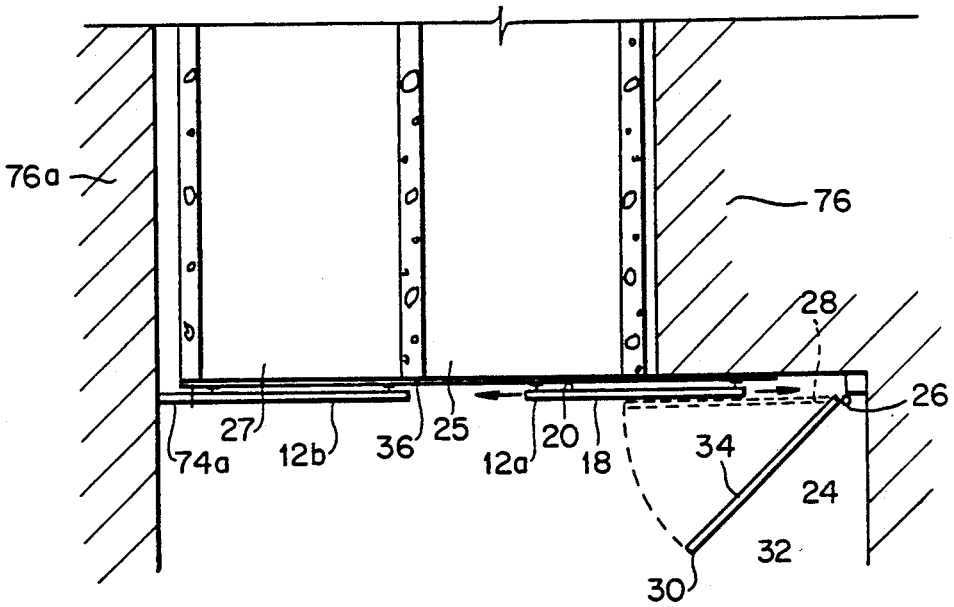
FIG. 3 shows a top view of the mausoleum cover of FIG. 1.

Each door has a front surface 18 and a rear surface 20. There is a pocket wall 22 which comprises an end panel 24 adjacent to the door 12*a*, 14*a*, or 16*a*, and rotatable around a pivot point 26 between a closed position 28 as shown in FIG. 3, and an open position 30. The end panel 24 has a front surface 32 and a rear surface 34. The pivot point 26 as shown in FIG. 3, is located a spaced distance from the wall surface 76*a* to make it possible for the crypt cover door 12*a* to slide behind the open end panel and to expose the crypt area 25, which may, or may not, contain a casket.

Figure 2:
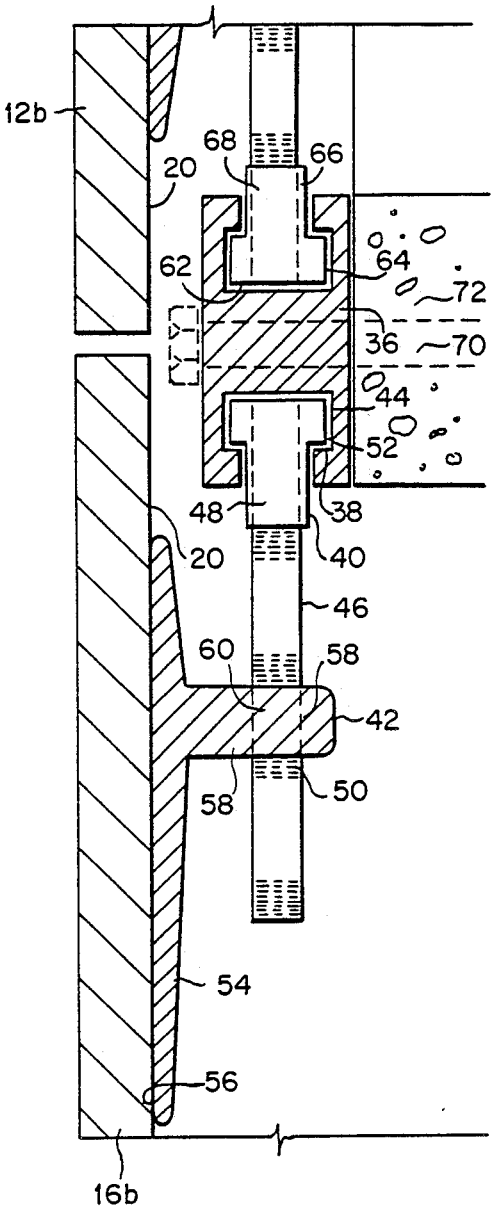
FIG. 2 shows a section view along line 2—2 of FIG. 1.
Figure 4:
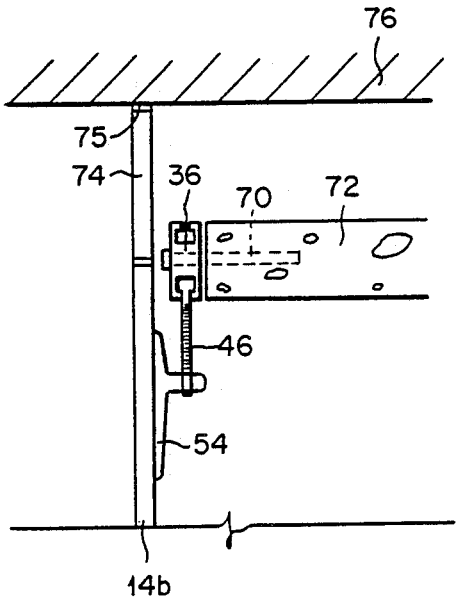
FIG. 4 shows a section view along line 4—4 of FIG. 1.

As shown in FIG. 2 there is a horizontal track 36 located a spaced distance behind the rear surface 20 of the crypt cover middle door 12*b*, and lower door 16*b*. In FIG. 4 the horizontal track is located behind the rear surface of crypt cover upper door 14*b*. The horizontal track 36 is also located a space distance behind the rear surface 34 of the end panel 24 as shown in FIG. 3. The horizontal track has a hollow guide rail 38, as shown in FIG. 2.

A connector means 40 is contained within the hollow guide rail 38 of the horizontal track. There is a means 42 for mounting the connector means 40 to the rear surface 20 to the crypt cover door 16*b* as seen in FIG. 2.

The end panel 24 in the closed position 28 prevents the horizontal movement of the moveable crypt door 12*a*, or 14*a*, or 16*a*. End panel 24 in its open position 30, as shown in FIG. 3, permits horizontal movement of the moveable crypt cover door 12*a*, or 14*a*, or 16*a*, along the horizontal track 36to a location behind the rear surface 34 of the end panel 24. This will expose a crypt 25 which is located behind the door 12*a*, or to expose an the crypt 27 located behind the door 12*b*. The crypt 25 or 27 may contain a casket or it may be empty.

The horizontal track 36 hollow guide rail 38 comprises at least one hollow internal rail of T-shaped internal dimensions 44. The connector means 40 includes a cylindrical shaft 46 having a T-shaped first end 48 and has an externally threaded second end 50. The T-shaped first end 48 is exactly corresponding in shape to the T-shaped hollow internal rail 38. The T-shaped first end 48 has external dimensions 52 smaller than the internal dimensions 44 of the hollow internal rail.

The mounting means 42 includes a plate 54 having a flat rear surface 56 attached to the rear surface 20 of the crypt cover door 12*a*, 12*b*, 14*a*, 14*b*, 16*a* or 16*b*. The mounting means 42 has an arm 58 perpendicular to the plate 54. The arm 58 has an internally threaded portion 60 for mating engagement with the externally threaded second end 50 of the connector means cylindrical shaft 46.

The horizontal track 36 may include more than one hollow internal rail. As shown in FIG. 2, the horizontal track 36 includes two hollow internal rails 38 and 62 respectively. Each rail has T-shaped internal dimensions 44 and 64 respectively. One of the hollow internal rails 44 is positioned in a back to back tandem relationship with respect to the other internal rail 64, as shown in FIG. 2. Each of the two hollow internal rails 44 and 64 contains a connector means 40 and 66 respectively, and T-shaped first end 48 of one connector means 40 is adjacent to, and inverted with respect to, the T-shaped first end 68 of the other connector means 66. T-shaped ends 48 and 68 are preferable coated with a friction reducing plastic such as neoprene. This arrangement is shown in FIG. 2. The moveable mausoleum cover also includes means 70, such as a screw threaded bolt, for attaching the horizontal track 36 to a support wall 72. The attaching means is preferably positioned between the two hollow internal rails 38 and 62. The dimensions of support wall 72 are narrow enough such that wall 72 does not interfere with the insertion into or withdrawal of a casket from a crypt. Wall 72 may be made of cement or steel.

FIG. 4 shows the how the upper portion of the mausoleum cover is connected to the horizontal track 36 for supporting a moveable upper crypt door 14*b*. Above moveable crypt door 14*b* is upper moulding 74 which is permanently attached to the upper wall 76 by means 75. This prevents the upper moulding 74 from moving horizontally, since moulding 74 is primarily for decorative purposes. In FIG. 3 it is also seen how the side wall moulding 74*a* is attached to the side wall 76*a*, in order to prevent any horizontal movement of the side wall moulding 74*a*. In other words, only the doors 12*a* or 12*b*, or 14*a* or 14*b*, or 16*a* or 16*b* are held within horizontal track 36 for horizontal movement thereof.

In FIG. 1, in the dashed lines it is indicated how door 12*a* would be moved to the right into the pocket wall area 22 whenever the end panel 24 is swung outwardly counterclockwise away from wall 76*a*. As soon as door 12*a* is moved as far as possible to the right, the crypt area 25 is accessable. If it desired to access crypt space 27, then after door 12*a* is moved to the right, door 12*b* would be moved to the right. The movement of 12*b* to the right would open the crypt space 27, and would simultaneously close the crypt space 25. Then after it is desired to close the crypt space 27, the door 12*b* would be moved to the left in order to close the crypt space 27 and to expose the crypt space 25. Movement of door 12*a* to the left would then close crypt space 25 such that end panel 24 could be rotated clockwise and cover up the pocket wall 22. If it is desired to have an empty space behind end panel 24, then this space can be used as an auxiliary storage area behind the pocket wall 22.

While only a single bodiment present invention has been shown and described, it is to be understood that many changes and modifications may be made thereto without departing the sphere and scope of the invention as defined in the appended claims.

What is claimed is:

1. A moveable mausoleum cover comprising at least one row of at least one crypt cover door moveable horizontally, said door having a front surface and a rear surface;

a pocket wall comprising an end panel adjacent to said door and rotatable around a pivot point, between a closed position and an open position, said end panel having a front surface and a rear surface;

a horizontal track located a spaced distance behind the rear surface of said crypt cover door and a spaced distance behind the rear surface of said end panel; said track having a hollow guide rail;

a connector means contained within said hollow guide rail;

means for mounting said connector means to the rear surface of said crypt cover door; and said end panel in said closed position preventing horizontal movement of said moveable crypt cover door, and said end panel in said open position permitting horizontal movement of said moveable crypt cover door along said horizontal track to a location behind the rear surface of said end panel, in order to expose a crypt located behind the door.

2. The moveable mausoleum cover of claim 1, wherein said horizontal track hollow guide rail comprises at least one hollow internal rail of T-shaped internal dimensions.

3. The moveable mausoleum cover of claim 2, wherein said connector means comprises a cylindrical shaft having a T-shaped first end and having an externally threaded second end.

4. The moveable mausoleum cover of claim 3, wherein said T-shaped first end is exactly corresponding in shape to said T-shaped hollow internal rail, and said T-shaped first end having external dimensions smaller than the internal dimensions of said hollow internal rail.

5. The moveable mausoleum cover of claim 1, wherein said mounting means comprises a plate having a flat surface attached to the rear surface of said crypt cover door; and said mounting means having an arm perpendicular to said plate, said arm having an internally threaded portion for mating engagement with the externally threaded second end of said connector means cylindrical shaft.

6. The moveable mausoleum cover of claim 3, wherein said horizontal track hollow guide rail comprises two hollow internal rails, each rail having T-shaped internal dimensions; and one of said hollow internal rails positioned in a back-to-back tandem relationship with respect to the other hollow internal rail.

7. The moveable mausoleum cover of claim 6, wherein each of said two hollow internal rails contains a connector means, said T-shaped first end of one connector means is adjacent to, and inverted with respect to, the T-shaped first end of the other connector means.

8. The moveable mausoleum cover of claim 6, further comprising means for attaching said horizontal track to a support wall; said attaching means positioned between said two hollow internal rails.

9. The moveable mausoleum cover of claim 1, wherein said one row is horizontal and comprises at least two crypt cover doors moveable horizontally, each door being moveable horizontally and independently from every other door.

10. The moveable mausoleum cover of claim 9, further comprising at least two horizontal rows of at least two moveable crypt cover doors, one of said horizontal rows positioned vertically above the other of said horizontal rows;

each door in each row being horizontally moveable independently from every other door.

* * * * *